US006125610A

United States Patent [19]

Mogard et al.

[11] Patent Number: 6,125,610

[45] Date of Patent: Oct. 3, 2000

[54] ANVIL FOR CLOSURE MOUNTING

[75] Inventors: Jens Mogard, Buffalo Grove, Ill.; Bengt Bengtsson, Mahtomed, Minn.; Kenneth Nortman, Hudson, Wis.

[73] Assignee: Tetra Laval Holdings & Finance, SA, Pully, Switzerland

[21] Appl. No.: 09/377,624

[22] Filed: Aug. 19, 1999

[51] Int. Cl.[7] ..... B65B 61/00; B65B 61/18

[52] U.S. Cl. ..... 53/133.2; 53/133.1; 53/565; 53/478; 493/87; 493/379

[58] Field of Search ..... 53/133.1, 133.2, 53/565, 467, 471, 478; 493/84, 87, 374, 379

[56] References Cited

U.S. PATENT DOCUMENTS

| | | | |
|---|---|---|---|
| 4,669,640 | 6/1987 | Ando et al. | 222/541 |
| 4,986,465 | 1/1991 | Jacobsson et al. | 229/123.3 |
| 5,065,938 | 11/1991 | Anderson | 229/125.08 |
| 5,101,999 | 4/1992 | Robichaud et al. | 220/258 |
| 5,110,041 | 5/1992 | Keeler | 229/125.15 |
| 5,735,426 | 4/1998 | Babcock et al. | 220/258 |
| 5,957,312 | 9/1999 | Adams et al. | 215/45 |
| 5,992,129 | 11/1999 | Tuckner et al. | 53/367 |

*Primary Examiner*—Peter Vo
*Assistant Examiner*—Hemant M. Desai
*Attorney, Agent, or Firm*—Welsh & Katz, Ltd.

[57] ABSTRACT

A vacuum spud supports an associated closure for transport and mounting to an associated package. The closure has a spout integral with an outwardly extending flange. The spud includes a main body portion having a central region and an outer support surface for supporting the closure at the flange. The outer support surface is generally planar. The spud defines a vacuum region formed in the main body portion extending below the support surface. The vacuum region is in flow communication with a vacuum manifold formed generally centrally disposed in the main body portion and configured for connecting to an associated vacuum source for establishing a vacuum in the vacuum manifold and vacuum region. When the closure is disposed on the spud, the closure is held on the spud by the vacuum exerted on the closure at the flange.

16 Claims, 1 Drawing Sheet

ANVIL FOR CLOSURE MOUNTING

FIELD OF THE INVENTION

This invention pertains to an anvil or spud for closure mounting. More particularly, this invention pertains to a vacuum spud for supporting a closure for mounting to a package.

BACKGROUND OF THE INVENTION

Molded resealable closures have become the norm for packaging of many products. This is particularly true in the packaging of food products such as milk, juice and the like. These closures have also come into widespread use in the packaging of particulate and solid food stuffs such as soups, as well as non-food items such as laundry detergent.

One typical use for these closures is in conjunction with a paperboard container such as a gable top carton. In such an arrangement, the closure is mounted to a top gable panel of the carton. Typically, these closures include threaded or snap-type caps to seal the closure and the container contents from the environs.

In one typical application, the closure assembly includes an outer flange and a pour spout extending from a surface of the flange. The flange is mounted to the carton, by, for example, ultrasonic welding. A membrane or barrier is formed as part of the closure, internal to the pour spout, and extends thereacross. The membrane provides a seal prior to initial use of the container, as well as indication as to whether the container has been opened or the contents tampered with.

In various applications, the carton and its contents are sterilized to reduce product degradation by, for example, contaminants, such as bacteria and the like. This also serves to extend the "shelf-life" of these food products. To reduce the opportunity for bacterial growth, it has been found that it is most advantageous to position the membrane flush with the flange to eliminate any pockets or corners that may be conducive to such bacterial growth.

In order to maintain product preparation and packaging at a cost effective level, packaging machines have been developed to operate at greater and greater speeds, while maintaining high sterility standards. Many such machines perform the overall function of "form, fill and seal" to form the package, fill the package and seal the package within sterile processing environments. This operation also includes the step of mounting the closure to the carton or package.

In one known arrangement, the closure is carried by an anvil, which is commonly referred to as a "spud", into contact with the carton material and supported as the closure is mounted to the carton. The closure is typically mounted to the carton by ultrasonic welding and other known processes. Due to the nature of the high speed equipment and the mechanical forces such as vibration to which the closure may be subjected during welding, a variety of arrangements are used to maintain the closure secured to the spud during transport and welding.

To secure the closure to the spud, one known arrangement uses detents formed on the spud and the closure that engage one another to frictionally hold the closure. While this arrangement may be an effective method for securing the closure during transport and welding, it can have its drawbacks, as any frictionally engaging mechanical systems will, vis-à-vis tolerances, fit and the like.

In another known arrangement, a vacuum is applied to the closure membrane, through the body of the spud, to secure the closure in place. However, it has been observed that these systems that use a vacuum applied directly to the membrane, to support the closure, can result in an unacceptably high rate of closure failures. It is believed that one failure mechanism is due to the application of the vacuum applied directly to the membrane. Because the membrane is thin and is spaced upwardly from the flange into the spout, undue forces are exerted at about the membrane-spout juncture which can result in fracture of the material at about the membrane edge region.

Accordingly, there exists a need for an anvil or spud for engaging and supporting the closure as it is moved into position adjacent the package material and while it is secured to the package. Desirably, such a spud uses a vacuum to hold the closure thereto during transport and mounting to the package material. Most desirably, the vacuum is directed away from the membrane and is configured to reduce or eliminate undesired stresses and forces on the closure, and in particular the membrane, which forces and stresses can otherwise result in membrane and/or closure failure.

SUMMARY OF THE INVENTION

A vacuum spud supports an associated closure for transport and mounting to an associated package. The closure has a spout integral with an outwardly extending flange and a membrane seal extending across an inner periphery of the spout at about the flange.

The spud includes a main body portion having a central region and an outer support surface for supporting the closure at the flange. Preferably, the central region is formed as a flat, planar surface for lying adjacent or in proximity to the closure membrane.

The outer support surface is generally planar and is configured for receiving the closure flange. The spud defines a vacuum region formed in the main body portion extending below the support surface. The vacuum region is in flow communication with a vacuum manifold formed generally centrally disposed in the main body portion and configured for connecting to an associated vacuum source for establishing a vacuum in the vacuum manifold and vacuum region. When the closure is disposed on the spud, the closure is held on the spud by the vacuum exerted on the closure at the flange. In a most preferred arrangement, the central region plane is at a height above that of the outer support surface plane.

In a preferred embodiment, the vacuum region is formed as a vacuum channel in the main body portion. Most preferably, the vacuum channel is formed below the support surface and is open thereto. In the preferred embodiment, the vacuum channel is continuous. In a present embodiment, the vacuum channel is formed in the spud having a generally semi-circular shape, and a having a rectangular cross-section.

To accommodate orientationally sensitive closures that may include a depending aligning projection, the spud can be formed with a projection receiving opening formed in the support surface. The projection receiving opening can be formed, at least in part, as part of the vacuum channel, that is, contiguous with the vacuum channel. Alternately, the receiving opening can be formed discretely from the channel.

The vacuum spud can include a mounting portion for mounting the spud to an associated vacuum source, such as that that can be provided with a form, fill and seal apparatus, e.g., a packaging machine. The vacuum manifold can be formed generally transverse to a plane defined by the vacuum channel, and the spud can include at least one vacuum passage extending from the vacuum manifold to the vacuum channel.

In a present embodiment, three vacuum passages extend from the vacuum manifold to the vacuum channel. The first vacuum passage is formed in the spud at an angle of about 90 degrees from the second vacuum passage, and a third vacuum passage is formed in the spud at an angle of about 90 degrees from the second vacuum passage, in opposing relation to the first vacuum passage.

Other features and advantages of the present invention will be apparent from the following detailed description, the accompanying drawings, and the appended claims.

DETAILED DESCRIPTION OF THE PREFERRED EMBODIMENTS

Figure 1:
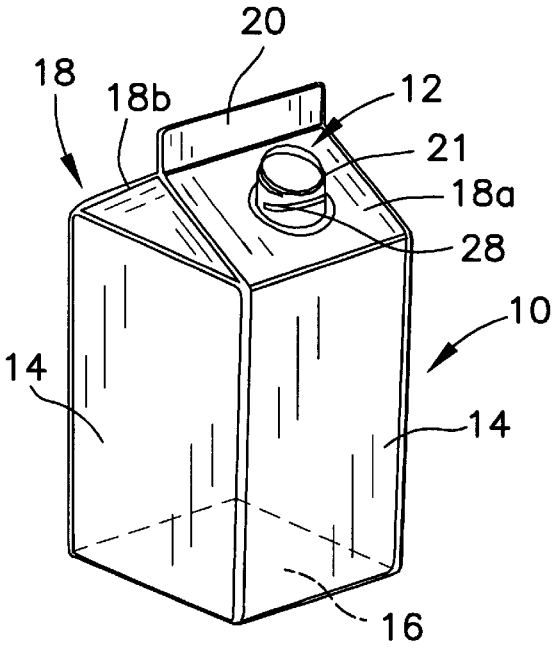
FIG. 1 is a perspective view of an exemplary carton onto which a closure is mounted using a spud embodying the principles of the present invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and in particular to FIG. 1, there is shown a gable top carton 10 having a closure 12 mounted thereto. The gable top carton 10 includes, in a typically constructed form, four side panels 14, a bottom panel 16 and a gable top 18 formed from, among other panels, a pair of gable panels 18*a,b* that terminate in a top seal 20. The closure 12 is mounted to the carton 10 at one of the gable panels, such as panel 18*a*. Other carton configurations will be recognized by those skilled in the art, and are contemplated to be within the scope of the present invention.

Figure 2:
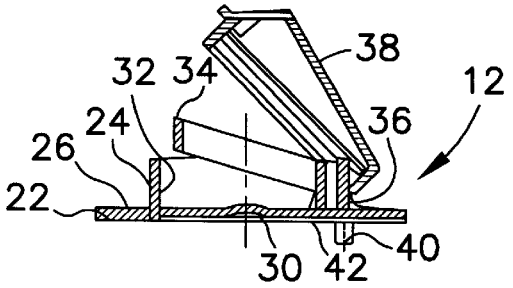
FIG. 2 is a partial cross-sectional view of an exemplary orientationally sensitive closure that is mounted to a carton using a spud in accordance with the principles of the present invention, the closure being illustrated with a sealing membrane formed therein flush with the closure mounting flange and a pull ring for removing the membrane from the spout.
Figure 4:
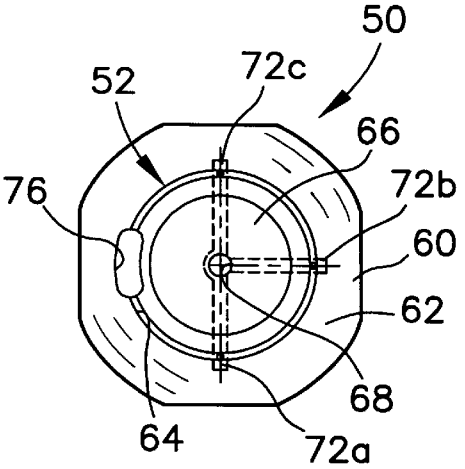
FIG. 4 is a top view of the spud of FIG. 3.
Figure 3:
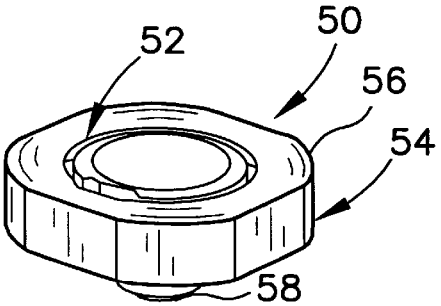
FIG. 3 is a top perspective view of a spud embodying the principles of the present invention.
Figure 5:
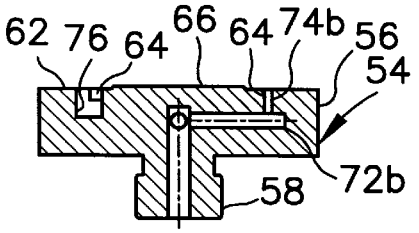
FIG. 5 is a cross-sectional view of the spud of FIG. 4 taken along line 5—5 of FIG. 4.

As seen in FIG. 2, the closure 12 includes a mounting flange 22 by which it is secured to the carton 10 material, and an upstanding pour spout 24 extending from a side or surface 26 of the flange 22. The closure 12 is mounted to the material at that side 26 of the flange 22 from which the spout 24 extends. Preferably, the closure 12 is resealable. A variety of resealable closure types are known, such as threaded closures (as shown in FIG. 1) which include a threaded cap (not shown) and threads 28 formed on the spout 24, and snap-type closures 12 (as shown in FIG. 2) which can be hinged and which snap onto a mating, engaging element formed on the spout and/or flange.

The closure 12 includes a membrane 30 formed therein that extends across the inner periphery 32 of the pour spout 24 to create a seal. In a known closure 12, the membrane 30 includes a pull ring 34 or like grasping member to facilitate breaking the membrane 30 and removing it from the spout 24. As discussed above, it is most desirable to position the membrane 30 as low within the spout 24 as possible, and most preferably, substantially flush with the mounting flange 22. This flange-flush arrangement reduces or eliminates pockets in the spout 24, below the membrane 30, in which product can collect. Those skilled in the art will appreciate that this flange-flush arrangement increases the ability to sterilize the packaged product, and thus reduces the opportunity for contamination or spoilage of the product.

In addition, certain types of closures, for example, snap-type closures 12 such as that illustrated in FIG. 2, are orientationally sensitive with respect to how they are mounted to the package 10. That is, an orientationally sensitive closure 12 must be mounted, for example, so that the closure hinge 36 is in an uppermost position (at about 12 o'clock when viewed relative to a clock face) so that the cap 38, when pivoted, is out of the product pour stream, or so that indicia that may be on the cap 38 is upright and readable. To this end, a variety of such closures 12 must be mounted to the package 10 in a specific, desired manner and location. In these instances, the closure 12 can include a depending aligning projection 40 extending from a side 42 of the flange 22 to facilitate proper orientation of the closure 12.

Referring now to FIGS. 3–7, there is shown a spud 50 having a vacuum communication system indicated generally at 52, formed therein, that is configured for transporting and supporting a closure 12. The spud 50 supports the closure 12 as it is transported to the package 10 material and as it is mounted to the material by, for example, ultrasonic welding. The spud 50 includes a main body portion 54 having a flange support portion 56 and a mounting portion 58 by which the spud 50 is connected to the overall form, fill and seal (e.g., packaging) apparatus (not shown). The flange support portion 56 can take any shape. In a current embodiment, the support portion 56 has a round shape or a square shape having rounded corners. The support portion 56 includes a support surface 60 having a generally planar outer support surface 62 on which the closure flange 22 rests during transport and mounting.

Unlike known vacuum-type spuds which apply a vacuum to the closure membrane, the vacuum communication system 52 of the present spud 50 applies a vacuum to the closure flange 22. By applying the vacuum to the flange 22, rather than the thinner membrane 30, it has been observed that a number of problems are overcome, such as an unacceptably high incidence of membrane failure. To this end, the flange support portion 56 includes a vacuum region 64 that is formed in the support surface 60. In a present embodiment, the vacuum region 64 is formed as a circular or near-circular channel formed in the support portion 56 that is open to the support surface 60. The channel 64 lies at about the outer support surface 62 and is spaced outwardly of an inner central region 66, which, in a preferred embodiment is also generally flat and planar.

The channel 64 can be formed having a square or rectangular cross-section, as illustrated, or can be formed having other cross-sectional shapes, such as semicircular shapes, defining a generally semi-toroidal channel. As will be apparent from the figures, the channel 64 generally defines a channel plane $P_C$ through about the center of the channel 64 that is parallel to a plane $P_{SS}$ defined by the outer support surface 62.

A vacuum manifold 68 is formed longitudinally through the mounting portion 58, preferably centrally disposed therein, that extends from an end 70 thereof toward, and into, the flange support portion 56. At least one and preferably a plurality of spoke-like vacuum passages 72*a–c* extend through the main body portion 54, from the vacuum manifold 68 to the vacuum channel 64. In a preferred embodiment, the passages 72*a–c* are formed parallel to the support surface 60 and include transverse passage portions 74*a–c* that extend upwardly from the radial spokes 72*a–c* to the channel 64. Thus, at least one and preferably a plurality of flow paths are provided from the vacuum source (not shown, but located at the end of the mounting portion 58) through the vacuum manifold 68 to the vacuum channel 64.

In a current embodiment, three vacuum passages 72*a–c* are formed in the spud 50 separated from one another by about 90 degrees, and extending from the centrally disposed vacuum manifold 68, outwardly toward the channel 64. It will be apparent from the figures that about 180 degrees separates the first and third passages 72*a,c*. In this embodiment, the channel 64 width $w_C$ (i.e., the radially extending distance) is configured so that the channel 64 resides fully within the confines of the closure flange 22. As such, the flange 22 fully covers or overlies the channel 64 so that the vacuum that is applied to the flange 22 is not compromised by any significant flow communication with the environs.

Figure 6:
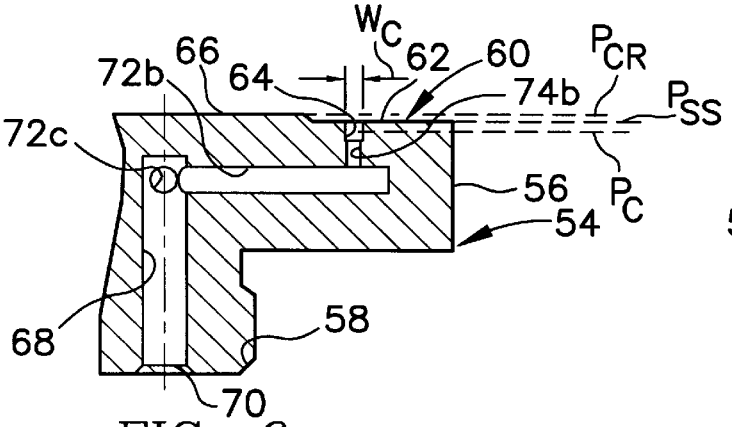
FIG. 6 is an enlarged partial cross-sectional view of the spud of FIG. 5.
Figure 7:
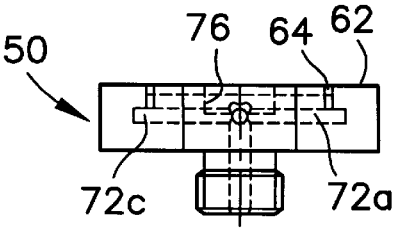
FIG. 7 is a side view of the spud of FIG. 5 illustrating, in phantom lines, the vacuum communication system formed therein.

As best seen in FIG. 6, the central region 66 of the support surface 60 lies in a plane $P_{CR}$ that is at a height about equal to, or slightly greater than, the height of the plane $P_{SS}$ of the outer support surface 62. In this configuration, and particularly when used with a flange-flush membrane 30, the spud 50 supports or at least is in proximity to the membrane 30 to reduce the opportunity to damage the membrane 30 during transport and mounting.

To accommodate those closures 12 that include the depending aligning projection 40, such as the orientationally sensitive closure 12 seen in FIG. 2, the spud 50 can include an elongated projection receiving opening 76 that is formed in the flange support portion 56, and can be formed integral with the vacuum channel 64. Alternately, the projection opening 76 can be generally circumferentially aligned with, but separated from the channel 64. The receiving opening 76 is configured to accommodate the aligning projection 40 or other centering element that may extend from the bottom surface 42 of the closure flange 22. The aligning projection 40, in conjunction with the projection receiving opening 76, facilitates properly orienting those closures 12 that may be positionally sensitive, such the flip-cap type closure 12 illustrated in FIG. 2.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A vacuum spud for supporting an associated closure for transport and mounting to an associated package, the closure having a spout integral with an outwardly extending flange, the spud comprising a main body portion having a central region and an outer support surface for supporting the closure at the flange, the outer support surface being generally planar, the spud defining a vacuum region formed as a vacuum channel in the main body portion below the support surface and open thereto, the vacuum channel having a generally semi-circular shape, the vacuum region being in flow communication with a vacuum manifold formed generally centrally disposed in the main body portion and configured for connecting to an associated vacuum source for establishing a vacuum in the vacuum manifold and vacuum region, wherein when the associated closure is disposed on the spud, the closure is held thereon by the vacuum exerted on the closure at the flange.

2. The vacuum spud in accordance with claim 1 wherein the vacuum channel has a rectangular cross-section.

3. The vacuum spud in accordance with claim 1 wherein the vacuum channel is continuous.

4. The vacuum spud in accordance with claim 1 including a projection receiving opening formed in the support surface configured to receive an aligning projection extending from the flange of the associated closure.

5. The vacuum spud in accordance with claim 4 wherein the projection receiving opening is, at least in part, formed as part of the vacuum channel.

6. The vacuum spud in accordance with claim 4 wherein the projection receiving opening is contiguous with the vacuum channel.

7. The vacuum spud in accordance with claim 6 wherein the vacuum channel is continuous.

8. The vacuum spud in accordance with claim 7 wherein the vacuum channel has a rectangular cross-section.

9. A vacuum spud for supporting an associated closure for transport and mounting to an associated package, the closure having a spout integral with an outwardly extending flange, the spud comprising a main body portion having a central region and an outer support surface for supporting the closure at the flange, the outer support surface being generally planar, the spud defining a vacuum region formed as a vacuum channel in the main body portion below the support surface and open thereto, the vacuum region being in flow communication with a vacuum manifold formed generally centrally disposed in the main body portion and configured for connecting to an associated vacuum source for establishing a vacuum in the vacuum manifold and vacuum region, wherein when the associated closure is disposed on the spud, the closure is held thereon by the vacuum exerted on the closure at the flange, wherein the spud includes a mounting portion for mounting to the associated vacuum source, and wherein the vacuum manifold is formed generally transverse to a plane defined by the vacuum channel, and wherein the spud includes at least one vacuum passage extending from the vacuum manifold to the vacuum region channel.

10. The vacuum spud in accordance with claim 9 including three vacuum passages extending from the vacuum manifold to the vacuum channel, a first vacuum passage being formed in the spud at an angle of about 90 degrees from a second vacuum passage and a third vacuum passage being formed in the spud at an angle of about 90 degrees from the second vacuum passage in an opposing orientation to the first vacuum passage.

11. A vacuum spud for supporting an associated closure for transport and mounting to an associated package, the closure having a spout integral with an outwardly extending flange, the spud comprising a main body portion having a central region and an outer support surface for supporting the closure at the flange, the outer support surface being generally planar, the spud defining a vacuum region formed in the main body portion extending below the support surface, the vacuum region being in flow communication with a vacuum manifold formed generally centrally disposed in the main body portion and configured for connecting to an associated vacuum source for establishing a vacuum in the vacuum manifold and vacuum region, wherein when the associated closure is disposed on the spud, the closure is held thereon by the vacuum exerted on the closure at the flange, wherein the central region defines a plane that is generally parallel to the plane defined by the outer support surface.

12. The vacuum spud in accordance with claim 11 wherein the central region plane is at a height above a height of the outer surface support surface plane.

13. A vacuum spud for supporting an associated closure for transport and mounting to an associated package, the closure having a spout integral with an outwardly extending flange and including a membrane extending across an inner area of the spout adjacent the flange, the spud comprising a main body portion having a substantially flat, planar central region configured to lie in proximity to the closure membrane, the spud including an outer support surface for supporting the closure at the flange, the outer support surface being a generally flat, planar surface, the spud defining a vacuum region formed as a vacuum channel in the main body portion extending below the support surface, the vacuum region being in flow communication with a vacuum manifold formed generally centrally disposed in the main body portion and configured for connecting to an associated vacuum source for establishing a vacuum in the vacuum manifold and vacuum region, the vacuum region including at least one radially extending vacuum passage extending from the vacuum manifold to the vacuum channel, wherein when the associated closure is disposed on the spud, the closure is held thereon by the vacuum exerted on the closure at the flange.

14. The vacuum spud in accordance with claim 13 wherein the vacuum channel defines a plane that is generally parallel to a plane defined by the outer support surface.

15. A vacuum spud for supporting an associated closure for transport and mounting to an associated package, the closure having a spout integral with an outwardly extending flange and including a membrane extending across an inner area of the spout adjacent the flange, the spud comprising a main body portion having a substantially flat, planar central region configured to lie in proximity to the closure membrane, the spud including an outer support surface for supporting the closure at the flange and defining a vacuum region formed in the main body portion extending below the support surface, the vacuum region being in flow communication with a vacuum manifold formed generally centrally disposed in the main body portion and configured for connecting to an associated vacuum source for establishing a vacuum in the vacuum manifold and vacuum region, wherein when the associated closure is disposed on the spud, the closure is held thereon by the vacuum exerted on the closure at the flange, and wherein the central region defines a plane that is parallel to and spaced from a plane defined by the outer support surface.

16. The vacuum spud in accordance with claim 15 wherein the plane defined by the central region defines is at a height greater than the plane defined by the outer support surface.

* * * * *